United States Patent [19]

Lestraden

[11] 4,314,772

[45] Feb. 9, 1982

[54] GROUND HEATING SYSTEM

[76] Inventor: Jakobus W. Lestraden, Nachtegall, 4, Sassenheim, Netherlands

[21] Appl. No.: 103,161

[22] Filed: Dec. 13, 1979

[51] Int. Cl.[3] ..... E01C 3/06

[52] U.S. Cl. ..... 404/27; 219/213; 52/170

[58] Field of Search ..... 404/71, 77, 27, 79, 404/28; 52/170; 219/213, 345

[56] References Cited

U.S. PATENT DOCUMENTS

| | | | |
|---|---|---|---|
| 795,772 | 7/1905 | Janney | 404/71 X |
| 1,050,914 | 1/1913 | Branch | 404/71 X |
| 1,349,136 | 8/1920 | Lillard | 404/71 X |
| 1,771,269 | 7/1930 | Musgrave | 404/71 X |
| 2,138,217 | 11/1938 | Sutter | 219/345 |
| 3,236,991 | 2/1966 | Graham | 219/213 |
| 3,377,462 | 4/1968 | Pferschy | 404/71 X |
| 3,491,439 | 1/1970 | DuBois | 404/77 X |

*Primary Examiner*—Nile C. Byers, Jr.
*Attorney, Agent, or Firm*—John J. Dennemeyer

[57] ABSTRACT

A ground heating system comprises a porous stabilization layer provided between a pipe system for supplying heat and a pipe system for supplying water to control the ground humidity. The stabilization layer functions as a water distributor and heat storage means.

6 Claims, 1 Drawing Figure

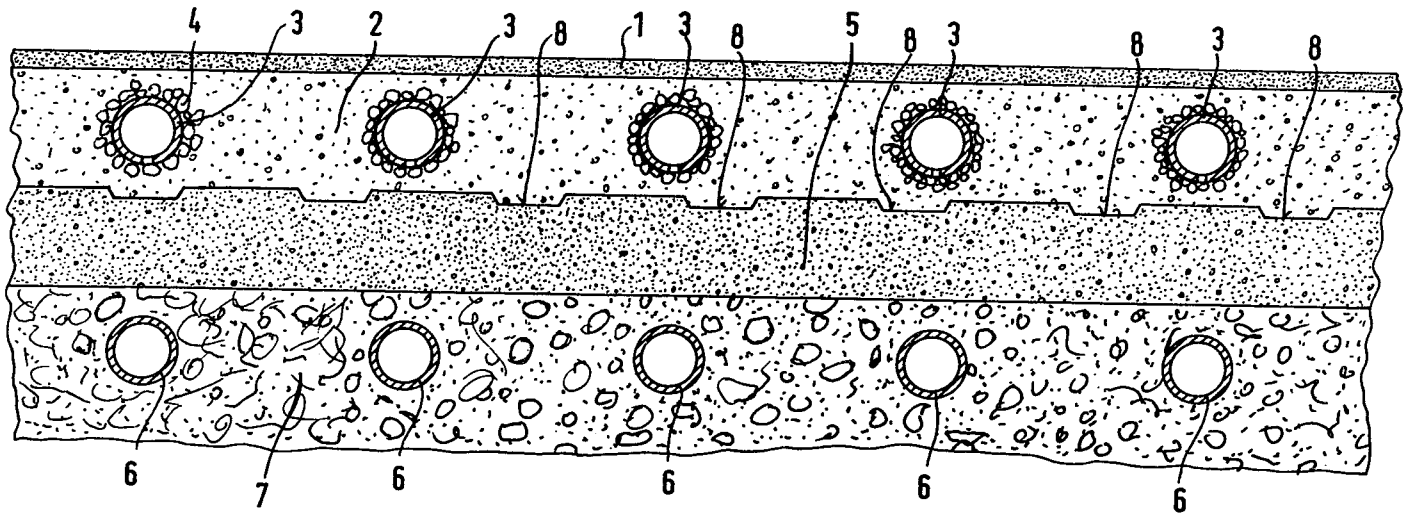
4
3
2
3
1
3
8
5
8
3
8
3
8
6
6
6
6
7

GROUND HEATING SYSTEM

BACKGROUND OF THE INVENTION

The invention relates to a ground heating system which is suitable for the heating of runways, take-off and landing strips, bridges, parking areas and the like to avoid the formation of ice and to remove snow by causing it to melt. It could also be desirable to use such a heating system for installations to quickly dry such runways or tracks after a rain fall and to prevent aquaplaning.

It is known to heat earth or ground layers near the surface by conducting warm water or steam through a pipe circuit. It has also been proposed already to produce the required heat by means of electrical resistances. Generally it has been discovered that such installations have an inherent problem of providing a proper heat transfer. Due to the heat input the ground is dried out in the vicinity of the heating pipe and an efficient heat transfer thereafter is practically impossible.

From this consideration systems have been proposed wherein the ground layers to be heated are supplied continuously by a system of humidification. According to Dutch Patent No. 26777 this problem was solved in that two concentric tubes have been used wherein the inner tube is traversed by the heating medium and the outer perforated tube is supplied with water in order to maintain the degree of humidity of the ground at a constant level. The perforated tube may further be used as a draining medium. It is also known to locate the heating tube in a porous layer, for example of pebble stones, which permits a uniform water supply.

It has been found that these systems present a number of disadvantages. On the one hand the installation according to the Dutch Patent No. 26777 does not provide any means of maintaining a uniform degree of humidity in the ground and accordingly the heat flow in the direction of the ground surface is inadequate.

It is also known that uniform and rapid heating of the surface can only be obtained when the heat exchanging element presents a relatively large surface. Furthermore the heating element must be able to reach a high temperature so that an efficient and rapid heat exchange takes place. It is also favorable when the heating pipes are not located too far from the surface, but this increases the risk of damage of the pipes or of the electrical cables or resistances.

SUMMARY OF THE INVENTION

Accordingly it is an object of the invention to provide an improved system for heating runways and other tracks for vehicle traffic which takes into consideration the above-mentioned disadvantages and provides an uniform heat transfer to the surface.

This object is obtained in that according to the present invention in the case of an installation of the above-mentioned type a porous stabilization layer is disposed between the system for heating the water for regulating the ground humidity and the system for supplying the heating energy. The porous stabilization layer functions as a water- and heat-distributor and represents furthermore a first class heat storage element with a corresponding after-heating effect.

Other objects and advantages of the invention will become more apparent in the light of the following detailed description of a preferred embodiment thereof as discussed and illustrated in the accompanying drawing.

BRIEF DESCRIPTION OF THE DRAWING

The single FIGURE of the drawing is a longitudinal cross-sectional view of a track in which the invention has been incorporated.

In a preferred embodiment according to the invention disclosed in the drawing the watering pipes 3 are located directly below the concrete or asphalt-concrete layer 1 in a bed of coarse sand 2 which may be substituted in the vicinity of the watering pipes 3 appropriately by pebble stones 4. In this manner the water flowing from the water distribution pipes 3 is first halted somewhat and dispersed before it reaches the coarse sand 2 which will thus not be washed away. The sand layer 2 distributes the water further and in this manner the subjacent porous stabilization layer 5 of sand-cement is watered uniformly. The stabilization layer 5 rests on the earth layer 7 in which heating pipes 6 are disposed for heating the track.

In case the slope of the track is greater in the longitudinal direction than the degree of curvature in the transverse direction there exists the danger that the water supply will flow to a major extent in the direction of the slope which then would lead to undesirable water congestions. This can be avoided when the stabilization layer 5 is provided with grooves 8 which extend in the transverse direction. Accordingly subsequent changes in the sand layer 2 are also eliminated.

An additional feature of the invention consists in that the watering system pipes 3 can be supplied either with warm or with cold water. Thus it is possible in a particular case when there is an unexpected frost and slippery surface to produce a very rapid heating, and on the other hand it may be desirable to supply cold water during very hot weather to prevent a melting of the track surface.

Although this invention has been shown and described with respect to a preferred embodiment thereof, it should be understood by those skilled in the art that various changes and omissions in the form and detail thereof may be made therein without departing from the spirit and scope of the invention.

What we claim is:

1. A ground heating system particularly for tracks such as runways, take-off and landing strips, parking lots and the like comprising a supply system for heat and a supply system for water to control the ground humidity wherein a porous stabilization layer is provided between the systems for the heat supply and the water supply to function as a water distributor and heat storage medium.

2. A ground heating system according to claim 1 wherein the surface of said stabilization layer is provided with grooves for distributing water and said grooves extend transversely to the longitudinal axis of the track.

3. A ground heating system according to claim 1 wherein the water supply system is embedded in a water permeable sand or pebble layer disposed above the stabilization layer.

4. A ground heating system according to claim 3 wherein the watering system is supplied selectively with hot or cold water.

5. A ground heating system according to claim 1, wherein said system for heat supply is disposed below said stabilization layer and said system for water supply is disposed above said stabilization layer.

6. A ground heating system according to claim 1, wherein said stabilization layer is made from sand-cement.

* * * * *